US005806262A

United States Patent [19]

Nagle

[11] Patent Number: 5,806,262

[45] Date of Patent: Sep. 15, 1998

[54] POST AND METHOD OF EMPLACING A POST

[75] Inventor: Gordon A. Nagle, West Brunswick Township, Schuylkill County, Pa.

[73] Assignee: Schuylkill Products, Inc., Cressona, Pa.

[21] Appl. No.: 759,472

[22] Filed: Dec. 5, 1996

Related U.S. Application Data

[60] Provisional application No. 60/007,990, Dec. 5, 1995.

[51] Int. Cl.[6] ..... E02D 27/00; E02D 27/32

[52] U.S. Cl. ..... 52/296; 52/259; 52/258; 52/742.14; 52/741.15; 52/292

[58] Field of Search ..... 52/296, 292, 250, 52/258, 259, 721.1, 721.2, 730.2, 741.13, 741.14, 741.15, 742.14, 745.18, 745.2

[56] References Cited

U.S. PATENT DOCUMENTS

| | | | |
|---|---|---|---|
| 4,147,009 | 4/1979 | Watry | 52/259 X |
| 4,783,935 | 11/1988 | Creager | 52/741.15 X |
| 4,785,593 | 11/1988 | Munoz, Jr. | 52/296 X |
| 4,848,050 | 7/1989 | Tanaka | 52/741.15 X |
| 4,998,393 | 3/1991 | Baena | 52/258 X |
| 5,501,057 | 3/1996 | Dawson | 52/741.15 X |
| 5,505,033 | 4/1996 | Matsuo et al. | 52/296 |
| 5,644,890 | 7/1997 | Koo | 52/742.14 |
| 5,678,382 | 10/1997 | Naito | 52/296 X |

*Primary Examiner*—Creighton Smith
*Assistant Examiner*—W. Glenn Edwards
*Attorney, Agent, or Firm*—Daniel A. Sullivan, Jr.

[57] ABSTRACT

The invention provides means and methods to erect and plumb a precast concrete post in a concrete footing embedment. In a method of the invention, the base of a post is connected with mounting hardware to a partial footing, followed by the pouring of a footing remainder around the base of the post and around the hardware. A post of the invention has an upper section and a base; the base contains a mounting hole. The post maintains essentially the same footprint from the upper section to the base. A post and panel structure of the invention is characterized by a post secured in a two-part footing, in which a secondary footing securely captures the post in the footing.

19 Claims, 5 Drawing Sheets

POST AND METHOD OF EMPLACING A POST

CROSS-REFERENCE TO RELATED APPLICATION

The benefit of provisional application No. 60/007,990 filed Dec. 5, 1995 is claimed.

TECHNICAL FIELD

The invention relates to methods of post emplacement and to posts which are specially adapted for practice of the method. The invention relates particularly to posts which have channels for wall support.

BACKGROUND OF INVENTION

One application of the invention is for sound walls. Sound walls are typically constructed of panels and posts. The panels close the space between the posts and are supported by the posts. Windloads on the panels can be significant, this necessitating that the posts be strong and that they be securely mounted in the earth.

According to one design of posts for these sound walls, the posts are precast concrete, with rebar protruding from the bottoms of the posts. U.S. Pat. No. 5,234,288 of Bone shows an example of this method of construction. In emplacing the post, a hole is dug in the earth, concrete slurry is poured into the hole, and the protruding rebar is inserted into the slurry, with the bottom of the post resting on the slurry. Wooden falsework supports the post, until the concrete cures.

U.S. Pat. No. 5,119,614 of Rex is similar to the patent of Bone as regards rebar likewise protruding and becoming embedded in a concrete anchor pad.

According to another design, the post has an extra precast length and it is this extra length which becomes embedded in the poured concrete. Examples of this technique, Ground Mounted Type A and Ground Mounted Type B, are shown in Standard BC-702 (Sep. 30, 1994), Sound Barrier Walls, of the Pennsylvania Department of Transportation (hereinafter "PDT"). This Standard BC-702 is incorporated here by reference to illustrate the state of the art.

DISCLOSURE OF INVENTION

An object of the invention is to provide new methods of post emplacement which improve on the above-described methods.

Another object of the invention is the provision of a novel post which is especially suited for practicing methods of the invention.

Another object of the invention is to provide means and methods for erecting the posts of precast concrete post and panel structures of any kind, including sound walls.

Other objects of the invention will become apparent from the remainder of this specification as set forth below.

The current practice of constructing precast concrete post and panel structures is similar to that used to build a common fence, where posts embedded in the earth support panels which span between the posts. The builder excavates a hole in the earth, similar to what is done for erecting utility poles. Then a concrete footing, which contains steel reinforcement and which also captures reinforcement protruding from, or encompassed in, the bottom of the post, is cast in concrete using the shape of the hole as its form. The post must be suspended in the hole until the concrete for the footing is set. Suspending the post does not allow for a great degree of precision in setting the position and orientation of the post and is very demanding of construction labor, equipment and material resources to construct or provide temporary supports to erect, suspend, and secure the post in the footing embedment.

In the present invention the excavation is completed and a partial footing is cast. When the concrete of the partial footing hardens, holes are drilled in the partial footing in positions set by locating templates. Then mounting bolts with leveling nuts are installed in the partial footing. The posts, which have precast mounting holes, are next positioned in place on the leveling nuts and held in place with mounting hardware and simple bracing. This is followed with a second concrete placement that embeds the post in the footing and covers the mounting holes and hardware. This work flow allows for more efficient erection of the posts.

In a method of constructing sound walls according to the invention, a caisson footing or a spread footing is first poured to an intermediate level, anchor bolts are placed in the footing at the intermediate level, and the post is leveled on the anchor bolts, using leveling nuts on the anchor bolts, and then locked in place using lock nuts on the anchor bolts. Following this, the remainder of the footing is poured around the base of the post and the anchor bolts and nuts.

A post of the invention has an upper, "H" cross-section over most of its length and a base whose cross section includes the "H" cross-section but additionally fills the channels of the "H" cross-section. The invention makes use of a configuration of the post end which incorporates holes in a solid base section that transitions to an upper, H-shaped post section that is needed to capture flat wall panels. Placing the holes straight vertically in the center of the post channels provides easy access for installation and leveling. The transition from solid to H-shape section also allows the secondary footing pour to securely capture the post while providing cover to the installation hardware.

Other important characteristics of the invention will become apparent in the remaining explanations below.

MODES OF THE INVENTION

Figure 1:
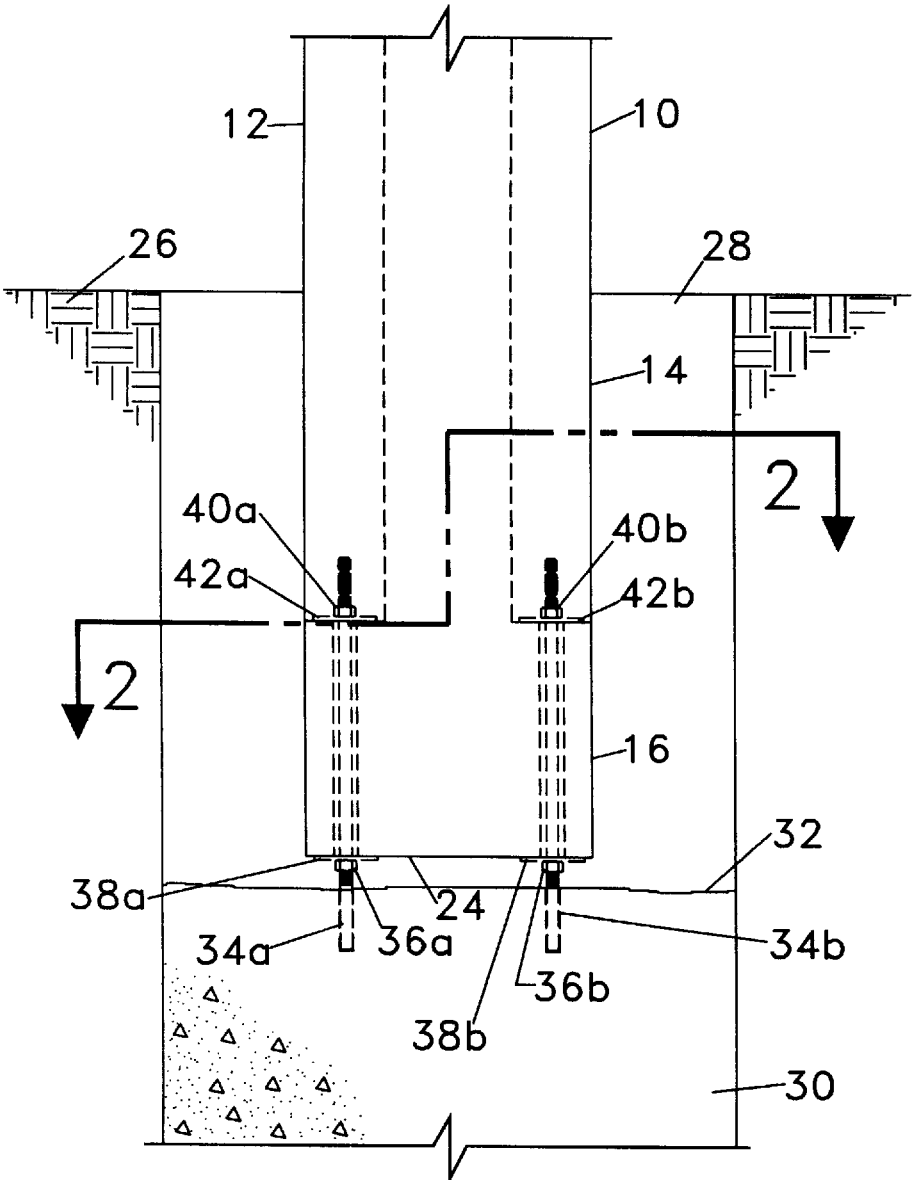
FIG. 1 is a front view of a post of the invention, at one stage in a method of the invention.

FIGS. 1–5B illustrate an example of a precast concrete post 10 of the invention in use in two stages of an example of a method of the invention. The post will be described first, and then the method.

The post has an "H" cross section in its upper section over most of its length, for instance in all of the above-ground portion 12, and in the initial below-ground portion 14. However, at the base, or bottom portion 16 of its length, it has a rectangular cross section, which is achieved by a change in the form used in the precasting process, such that the channels 18*a,b,* which extend over most of its length on opposite sides thereof, are filled with concrete in the bottom portion during the precasting process.

Bottom portion 16 contains two plastic (for instance, polyvinyl chloride) sleeves 20*a,b* (FIG. 4), whose purpose is to create mounting holes 22*a,b* in the precasting process. The mounting holes extend vertically from the bottom surface 24 of the post, to the lower ends of the channels 18*a,b,* i.e. to the steps 46*a,b.*

Placing the mounting holes in the shadow of the channels means that the post maintains essentially the same footprint; i.e., essentially it is the case that no part of the mounting flange represented by the rectangularly cross-sectioned bottom portion 16 lies at any greater distance from the axis of the post than do the parts of the H cross-section. This is of special advantage for embedded post constructions, such as the above-mentioned Ground Mounted Type A and Ground Mounted Type B constructions, where a mounting flange of greater lateral dimensions than the post would necessitate greater lateral dimensions for the footing and thus cause an increase in the amount of concrete needed for the footing.

Figure 5:
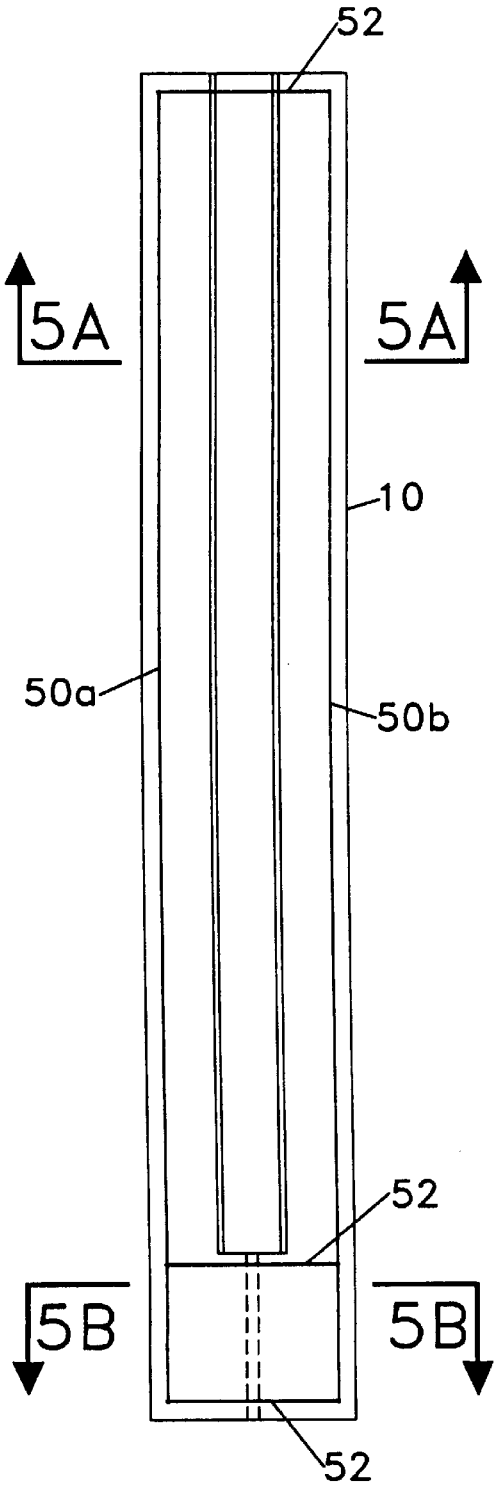
FIG. 5 is a side view of a post of the invention. Internal steel reinforcement is shown by heavy dark lines, according to custom in the field of reinforced concrete. Reinforcement sunk on the side faces of the post has not been drawn in FIG. 5, so as not to clutter the drawing; the presence of such reinforcement is indicated on the cross sections of FIGS. 5A and 5B.
Figure 5A:
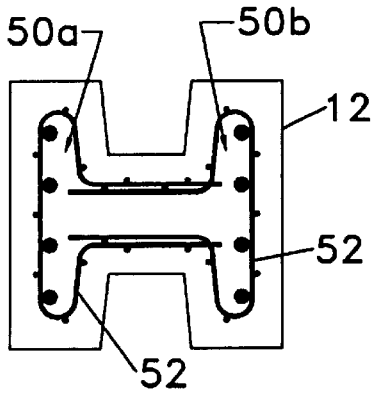
FIG. 5A is a cross sectional view taken on the cutting plane 5A—5A of FIG. 5. Internal reinforcement is shown by heavy dark lines and dots, again according to custom in the field of reinforced concrete.
Figure 5B:
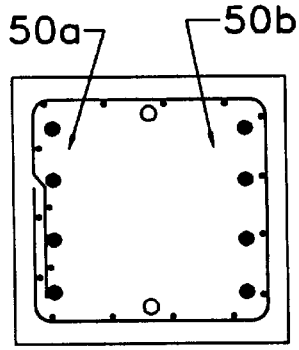
FIG. 5B is a cross sectional view taken on the cutting plane 5B—5B of FIG. 5. Here, also, internal reinforcement is shown by heavy dark lines and dots.

A steel reinforcement for post 10 is displayed in FIGS. 5, 5A, and 5B, and is composed of sets 50*a,b* of four longitudinal stringers, in the form of reinforcing bar, sunk on the front and back faces of the post, and epoxy-coated, welded wire fabric 52 sunk on all faces of the post and in the bottom portion 16 at the transition between the H-cross section and the rectangular cross section. The reinforcement is sunk to a depth of about 1½ inches from the faces.

In the method of the invention, the earth is first excavated for the intended footing. In the example of the Figs., the footing is a caisson footing for the post of a sound wall. It is assumed that the integrity of the earth 26 is such that no form is required; i.e. the concrete is poured directly into the hole left by the excavation. In cases where the ground is not self-supporting, a form would be used.

Figure 2:
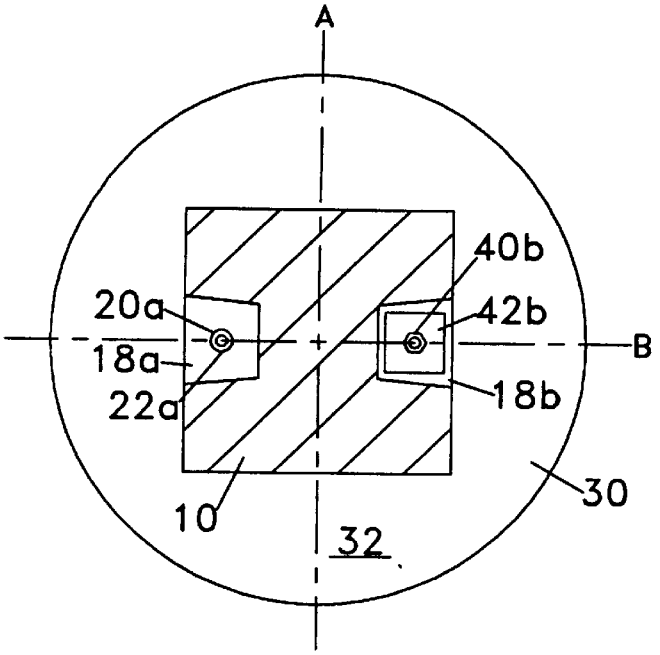
FIG. 2 is a cross sectional view according to cutting plane 2—2 of FIG. 1.

In FIGS. 1 and 2, several steps of the method have already been carried out. Hole 28 has been dug in the earth. The dimensions of the hole, i.e. the dimensions of the footing, are determined from the external loads for which the structure is designed and by the soil conditions. Prior to the pouring of concrete into the hole to form the caisson, a steel reinforcement basket is placed in the hole. The steel reinforcement may be as shown on sheet 2 of the above-referenced PDT Standard BC-702, for Ground Mounted Type A, and is not shown here. Concrete caisson 30 has been initially poured to an intermediate level 32, which is above the floor of the hole a sufficient distance to provide sufficient depth of concrete for insertion of the bolts and to provide preliminary support of the post in the subsequent steps of the method to be described below. For a caisson, intermediate level 32 may be, for example, three feet below ground level. For a spread footing (Ground Mounted Type B of said Standard), the distance between the intermediate level and ground level would be less.

When this initial pour of concrete has cured to adequate strength, a template (not shown) is placed on the concrete surface at the intermediate level to guide the drilling of holes in the concrete for securement of the lower ends of bolts 34*a,b.* Securement may be accomplished using a bonding resin (not shown), which is injected around the bolts. A suitable resin is Kelibond resin of Kelken-Gold, Inc., Princeton, N.J. An example of a suitable system for anchoring the lower ends of the bolts is the anchor system 34 of U.S. Pat. No. 4,954,009. U.S. Pat. Nos. 4,954,009 and 4,642,964 of Kellison are incorporated by reference. Instead of the plate or washer 35 of U.S. Pat. No. 4,954,009, it may be advantageous to provide a rectangular washer, like that shown in FIG. 5 of U.S. Pat. No. 5,218,805, which has a special slot for introduction of the resin. U.S. Pat. No. 5,218,805 of Rex is incorporated by reference.

The bolts carry leveling nuts 36*a,b* and leveling washers 38*a,b.* The leveling nuts are initially leveled using a spirit level extended between their washers. Post 10 is then lowered onto the washers. In the case of a caisson footing, hole diameter may be 36 inches, for example, so that there is room for a technician to stand down on the intermediate level, between the post and the reinforcement protruding out of the intermediate level, in order to adjust the leveling nuts, should that be necessary beyond the initial leveling to assure that the post is vertical about horizontal axis A (FIG. 2).

Figure 1B:
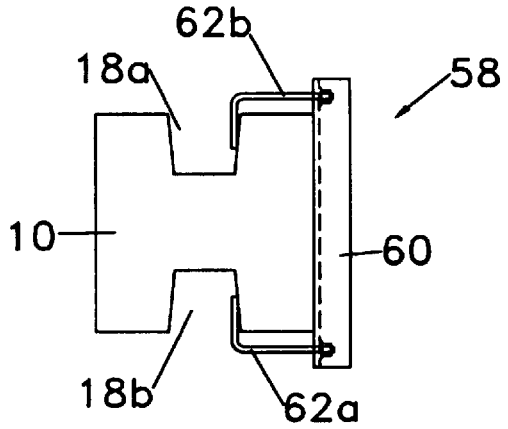
FIG. 1B is a top view of a portion of FIG. 1A.
Figure 1A:
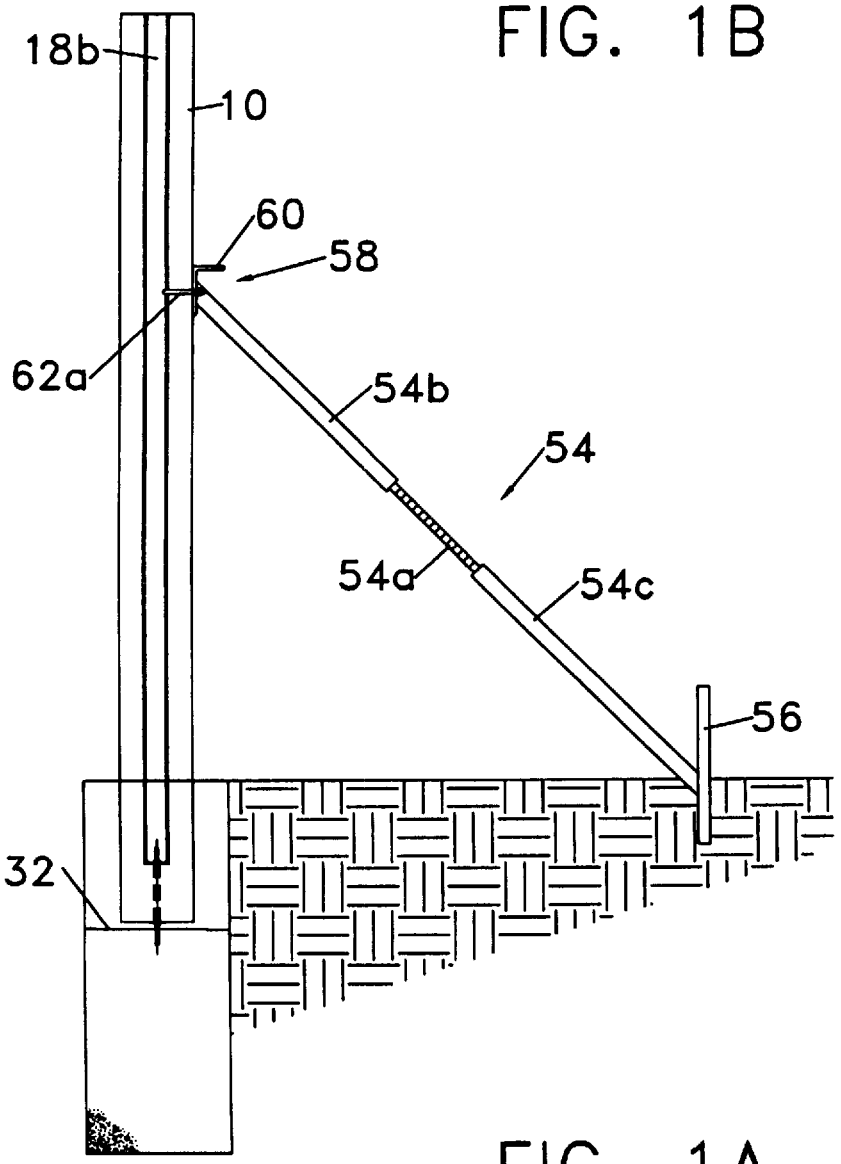
FIG. 1A is a side view of FIG. 1.

A knee brace 54, as shown in FIG. 1A, temporarily holds post 10 against rotation about horizontal axis B (FIG. 2). The knee brace is suitably connected between stake 56 in the ground and collar 58 on the post. The knee brace is built of a central, externally threaded rod 54*a,* which engages internal threading in pipes 54*b,c.* This provides the knee brace with an adjustable length for use in bringing post 10 into the vertical position, as measured about horizontal axis B. Collar 58 is constructed of a length of angle iron 60 and J-bolts 62*a,b.* Nuts and washers on the J-bolts enable a temporary connection to post 10, as shown in FIG. 1B.

Next, lock nuts 40*a,b* and lock washers 42*a,b* are installed, this reaching the stage of the method shown in FIGS. 1 and 2.

Figure 4:
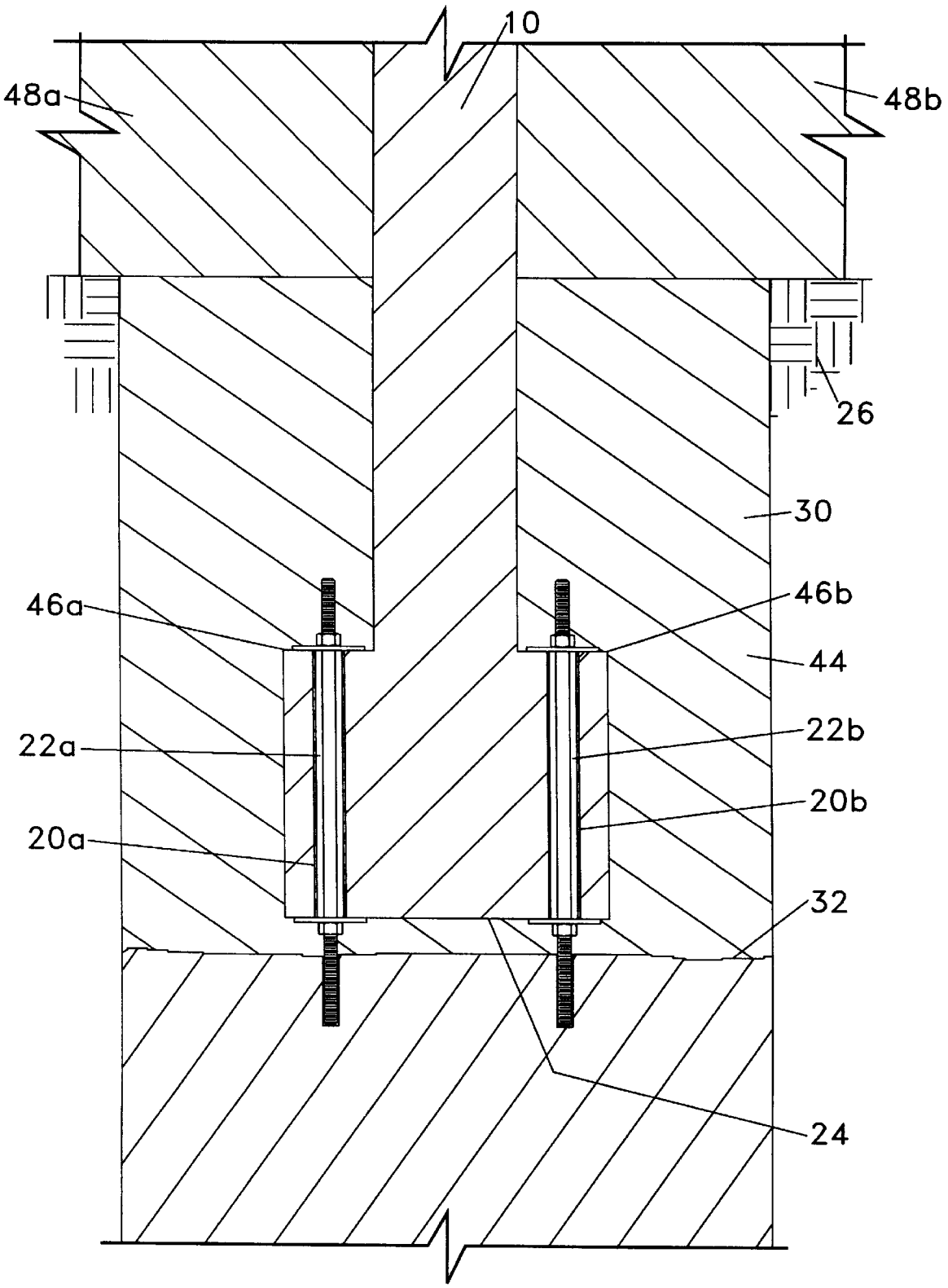
FIG. 4 is a cross sectional view according to cutting plane 4—4 of FIG. 3.

As compared with FIG. 4 of the above-mentioned patent of Bone, leveling is easier to achieve in the present invention. Here, leveling about the first of the two perpendicular, horizontal axes A and B is done using the leveling nuts. This makes the leveling about the second axis with the brace simpler than in Bone, where the leveling about both axes has to be done with a brace alone.

In the case of the embedded post constructions of Ground Mounted Type A and Ground Mounted Type B, it is even known to hold the post suspended vertically with a crane, until the concrete cures. The present invention offers the advantage of freeing the crane for the next post, almost immediately after the preceding post has been set in place on the bolts.

Figure 3:
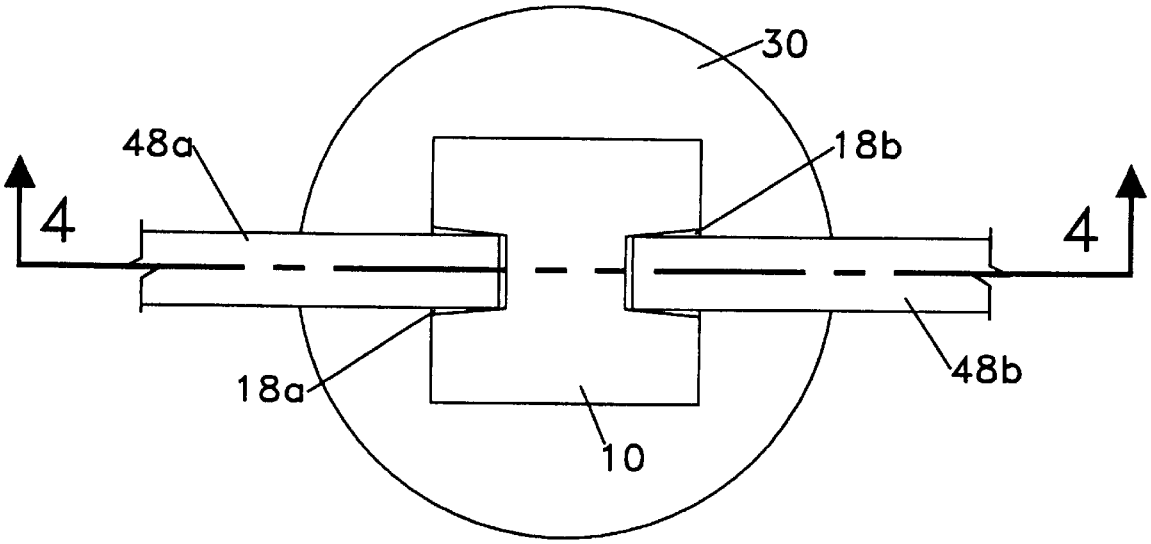
FIG. 3 is a top view at a later stage in the method of FIG. 1.

FIGS. 3 and 4 illustrate the state following performance of the remainder of the steps of the method. The upper portion 44 of the concrete caisson has been poured and allowed to cure. The steel reinforcement of the caisson has now been totally engulfed by the concrete. The leveling and lock bolts, nuts and washers are covered, and the post is caught in the caisson by the steps 46*a,b* at the lower ends of the channels 18*a,b.*

Concrete panels 48*a,b* have been inserted into the channels 18*a,b* and rest on the ground and on the upper surface of the concrete caisson 30. Joint sealer or sponge rubber backer rod (neither shown in the drawings) may be used at the contacts between the panels and the channels; see the above-referenced PDT Standard BC-702.

While the invention has been illustrated here on the basis of a sound-wall structure, it will be apparent to those skilled in the art that the principles of the invention may, as well, be applied to post, panel, footing structures in general, such as in the case of building walls, security walls, retaining walls, etc.

There follows, now, the claims. It is to be understood that the above are preferred modes of carrying out the invention and that various changes and alterations can be made without departing from the spirit and broader aspects of the invention as defined by the claims set forth below and by the range of equivalency allowed by law.

What is claimed is:

1. A method of erecting a post, comprising the steps of mounting a base of a post with mounting hardware to a partial footing, and then pouring a footing remainder around the base of the post and around the hardware, the post having an upper section above the base, the upper section having a footprint, the base and mounting hardware being contained essentially within said footprint.

2. A method as claimed in claim 1, the post having an upper section above the base, the post undergoing a transition from the upper section to the base allowing the footing remainder to securely capture the post.

3. A method as claimed in claim 1, the step of mounting including leveling of the post with said mounting hardware about a first of two perpendicular, horizontal axes.

4. A method as claimed in claim 3, the mounting hardware comprising two bolts passing through separated holes in the base and a leveling nut on each bolt beneath the base, whereby relative turning of the nuts on the bolts rotates the post about the first of said axes.

5. A method as claimed in claim 3, the step of mounting further comprising applying a brace to the post for leveling about the second of the axes.

6. A method as claimed in claim 5, the brace comprising a knee brace of adjustable length for rotating the post about the second of the axes.

7. A method as claimed in claim 1, the post comprised of precast concrete and containing a channel for insertion of a panel.

8. A method as claimed in claim 1, further comprising excavating a hole in the earth for a footing, pouring the partial footing, and allowing the partial footing to cure, the step of mounting comprising drilling holes in the partial footing, placing anchor bolts in the partial footing, placing leveling nuts on the anchor bolts, positioning the base on the leveling nuts, leveling the post with the leveling nuts, and locking the post in place with lock nuts on the anchor bolts.

9. A post comprising an upper section and a base, the base containing a mounting hole, the post maintaining essentially the same footprint as the base from the upper section to the base.

10. A post as claimed in claim 9, the upper section having a channel, the hole lying in the shadow of the channel.

11. A post as claimed in claim 10, further comprising a second such channel and hole combination.

12. A post as claimed in claim 11, the channels lying on opposite sides of the upper section.

13. A post as claimed in claim 9, the upper section having an "H" cross-section.

14. A post as claimed in claim 13, the base having a rectangular cross section.

15. A post as claimed in claim 14, the hole lying beneath a recess of the "H" cross-section.

16. A post as claimed in claim 9, comprised of precast concrete.

17. A post as claimed in claim 16, containing steel reinforcing.

18. A post and panel structure wherein a post is secured in a footing comprised of a partial footing and a secondary footing, the secondary footing securely capturing the post in the footing, the post having an upper section above a base, the upper section having a footprint, the base being contained essentially within said footprint.

19. A structure as claimed in claim 18 wherein installation hardware connects the post to the partial footing, the secondary footing covering the installation hardware.

* * * * *